US005253710A

United States Patent [19]

Carter et al.

[11] Patent Number: 5,253,710

[45] Date of Patent: Oct. 19, 1993

[54] METHOD AND APPARATUS TO CUT AND REMOVE CASING

[75] Inventors: Thurman B. Carter, Pearland; Shane P. Hart, Houston; Carl D. Reynolds, Alvin, all of Tex.

[73] Assignee: Homco International, Inc., Pearland, Tex.

[21] Appl. No.: 951,305

[22] Filed: Sep. 22, 1992

Related U.S. Application Data

[63] Continuation of Ser. No. 824,863, Jan. 22, 1992, abandoned, which is a continuation of Ser. No. 672,089, Mar. 19, 1991, abandoned.

[51] Int. Cl.[5] ..... E21B 29/00

[52] U.S. Cl. ..... 166/298; 166/55.6; 166/216; 166/301

[58] Field of Search ..... 166/55, 55.6, 55.8, 166/63, 298; 175/406, 61, 279

[56] References Cited

U.S. PATENT DOCUMENTS

| | | | |
|---|---|---|---|
| 2,991,834 | 7/1961 | Kennard | 166/55.7 |
| 3,332,492 | 7/1967 | Thomas | 166/55.8 |
| 3,419,077 | 12/1968 | Sanford | 166/55.8 |
| 3,570,598 | 3/1971 | Johnson | 166/178 |
| 4,047,568 | 9/1977 | Aulenbacher | 166/55.8 |
| 4,646,826 | 3/1987 | Bailey et al. | 166/55.8 |
| 4,811,785 | 3/1989 | Weber | 166/242 |
| 5,014,780 | 5/1991 | Skipper | 166/55.8 |

FOREIGN PATENT DOCUMENTS

| | | |
|---|---|---|
| 0155129 | 9/1985 | European Pat. Off. . |
| 2194978 | 3/1988 | United Kingdom . |

OTHER PUBLICATIONS

Publication by The Red Baron (Oil Tools Rental), entitled The Red Baron-Sales and Service Catalogue, pp. 12-15, dated "1990-91", published in the 1990-91 Composite Catalog.

Publication of Houston Engineers, Inc., entitled "Universal Rotating and Releasing Spear," p. 14, published 1983.

Catalogue of A-Z International Tool Co., entitled "A-Z Hydraulic Spear" pp. 183 and 184, published 1976-77.

A-Z International Tool Co., entitled "A-Z One Trip Cut and Recover Method," p. 192, published 1976-77.

A-Z Grant General Catalog 1990-91, pp. 120-8, 120-9, published in the 1990-91 Composite Catalog.

*Primary Examiner*—Ramon S. Britts
*Assistant Examiner*—Frank S. Tsay
*Attorney, Agent, or Firm*—Arnold, White & Durkee

[57] ABSTRACT

An apparatus is established which facilitates the cutting and removal of well casing on a single trip into the wellbore. The apparatus is run into the wellbore on the tubing string and provides a rotatable sleeve including grapples adapted to engage the casing, and to facilitate removal of the casing. The apparatus also includes cutting assemblies coupled to the mandrel, which may be rotated so as to cut the casing, thereby facilitating removal of the casing through use of the grapples.

16 Claims, 11 Drawing Sheets

Fig. 1A
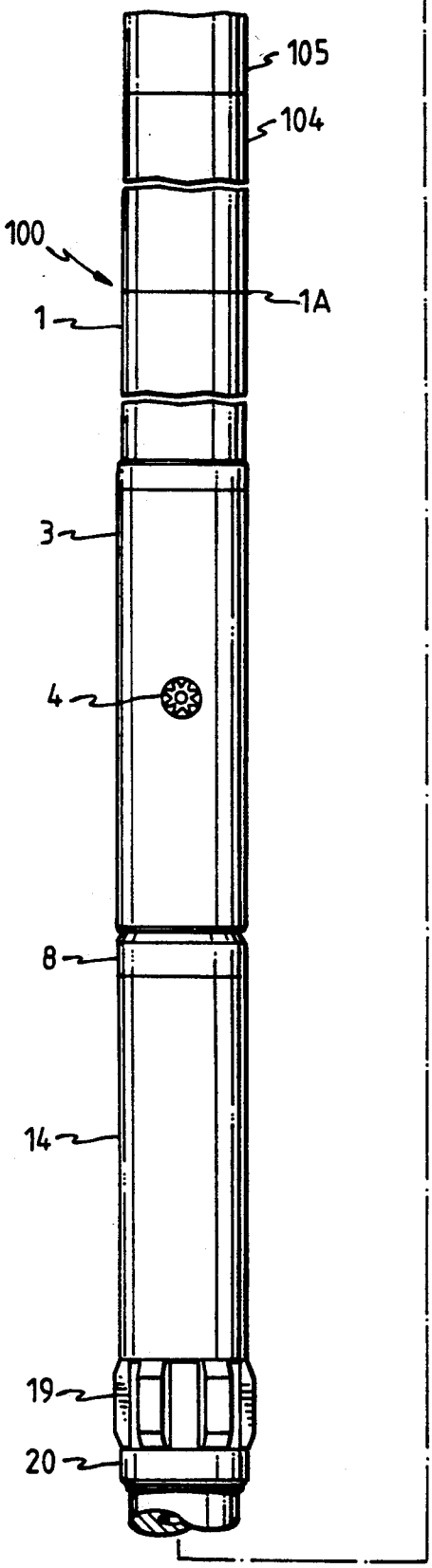
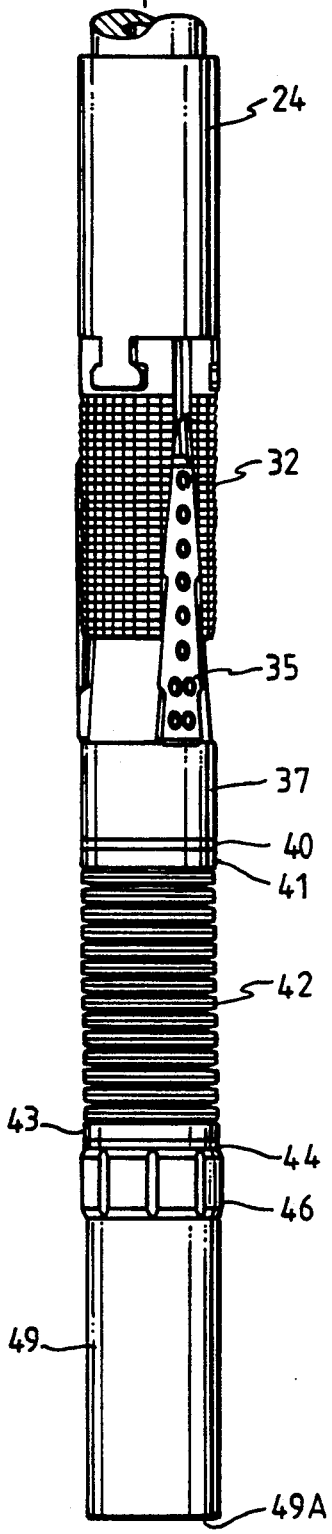
Fig. 1B

Fig. 2A
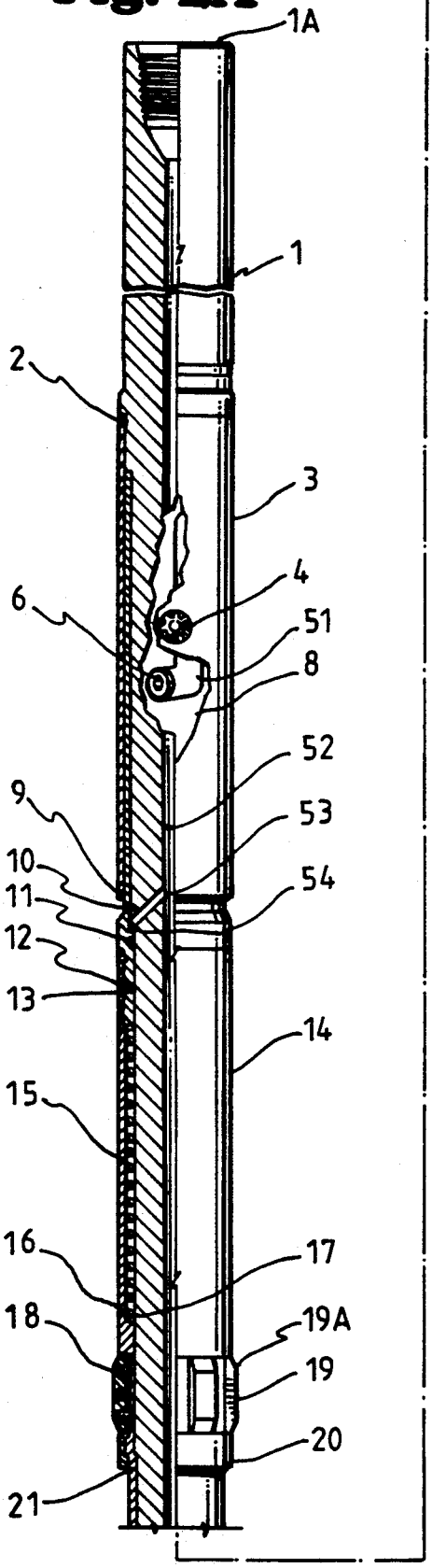
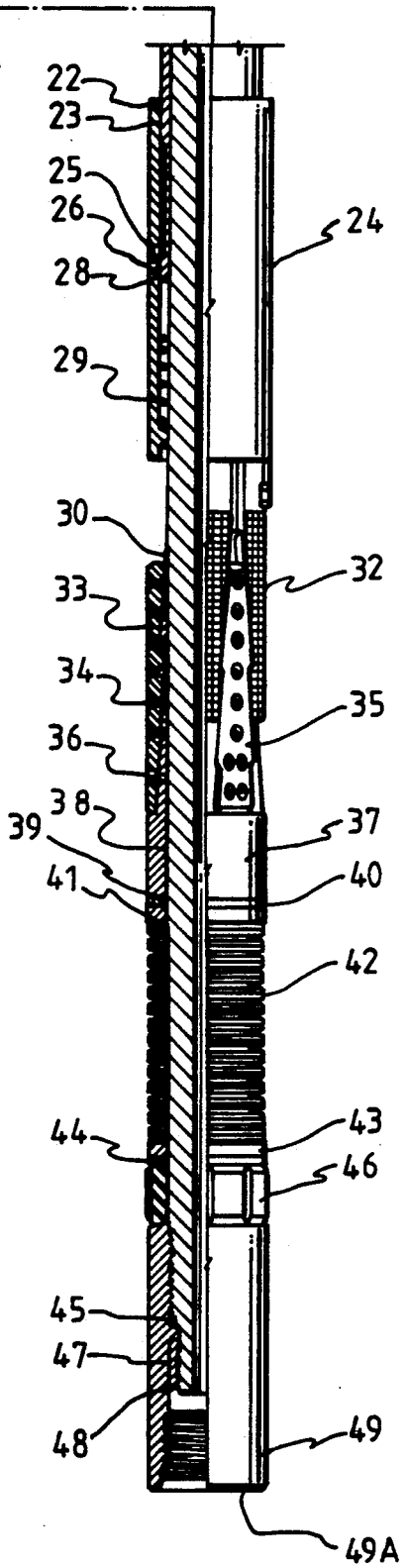
Fig. 2B

Fig. 3
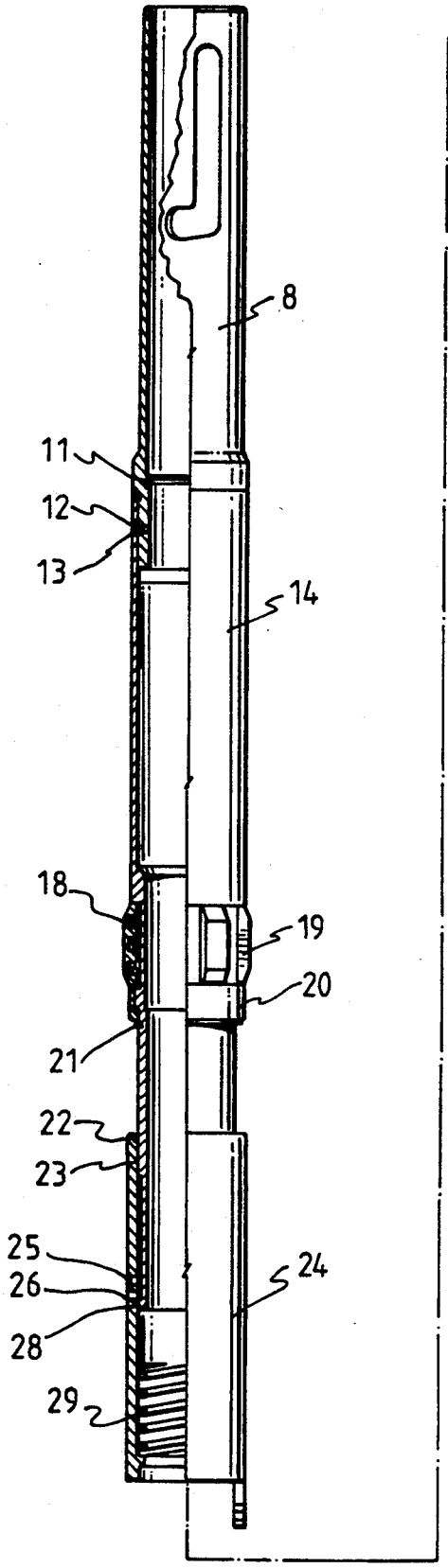
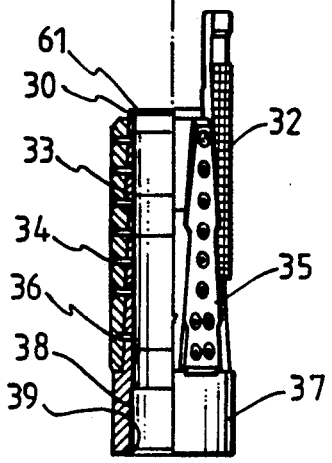
Fig. 4
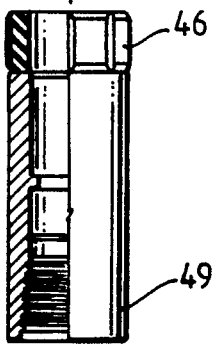
Fig. 5

Fig. 7A
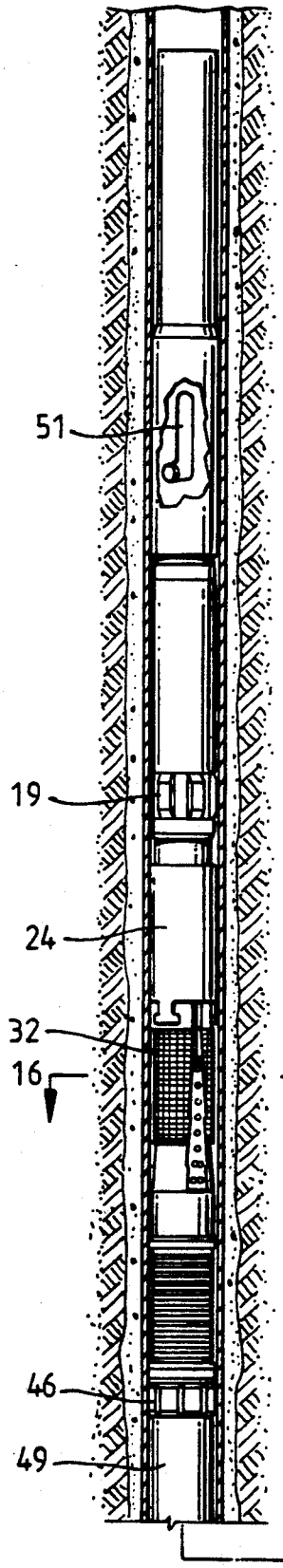
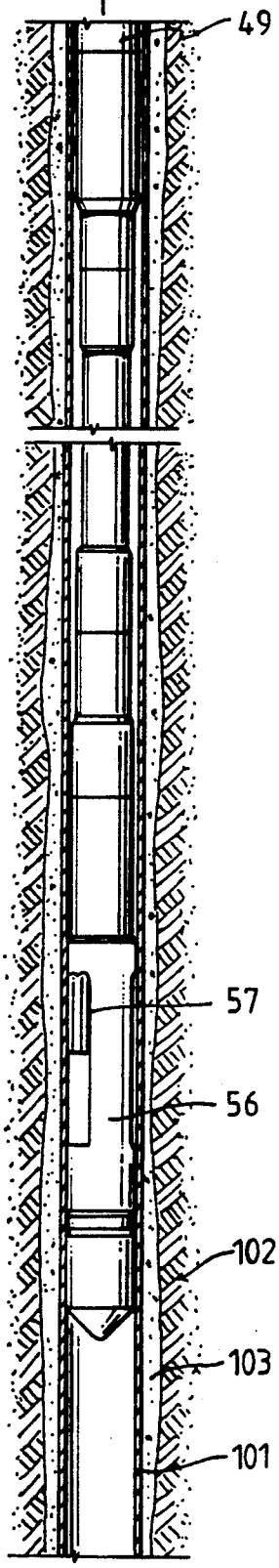
Fig. 7B

Fig. 8A
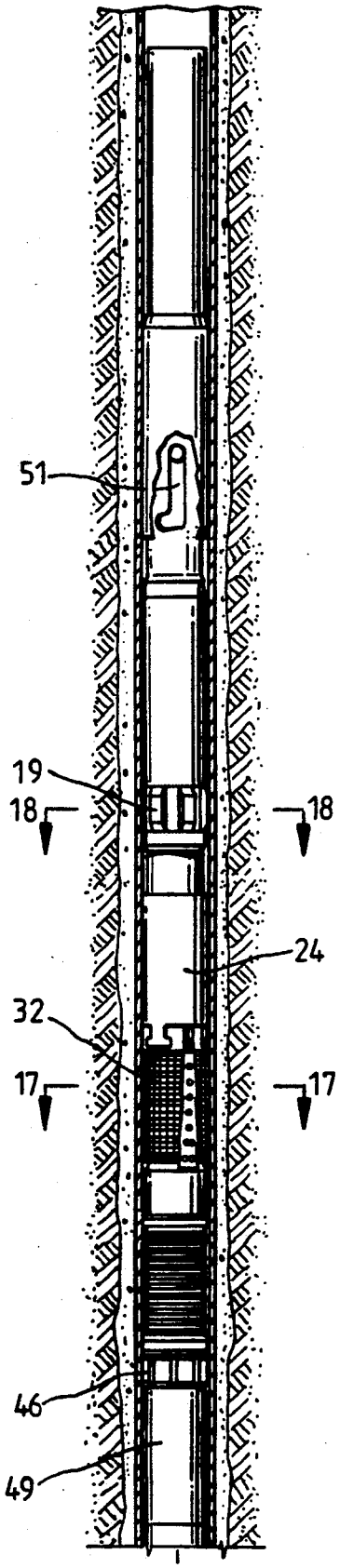
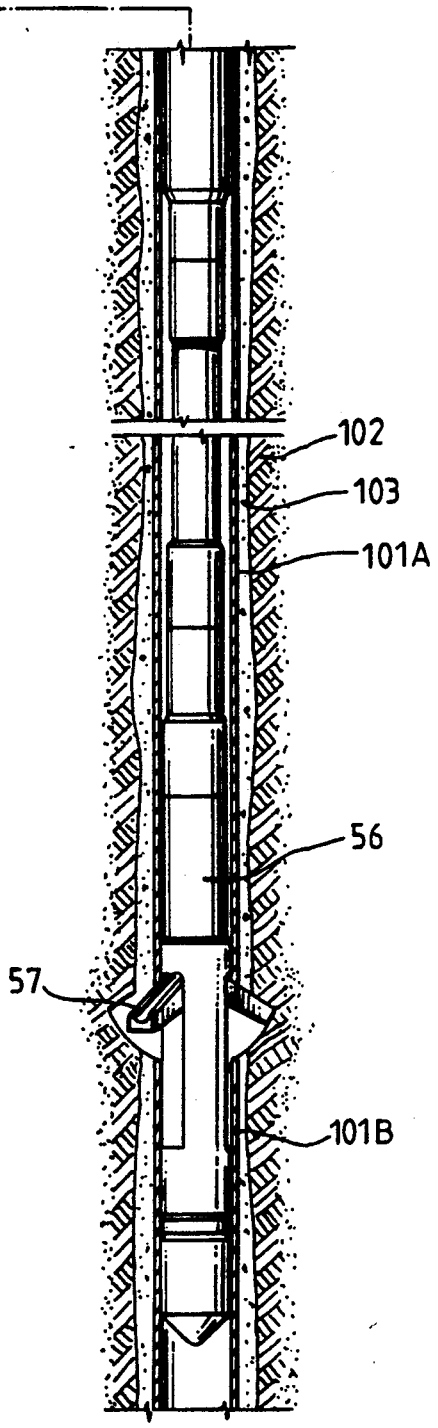
Fig. 8B

METHOD AND APPARATUS TO CUT AND REMOVE CASING

This application is a continuation of application Ser. No. 824,863, filed Jan. 22, 1992, now abandoned, which is a continuation of Ser. No. 672,089, filed Mar. 19, 1991, now abandoned.

BACKGROUND OF THE INVENTION

A. Field of the Invention

The present invention is directed generally to a method and apparatus to cut and remove well casing, and, more specifically, is directed to a method and apparatus to cut well casing and extract it from the well bore in a single downhole trip. B. Background In oil and gas exploration and development operations it is often desirable to remove casing which has previously been set in the wellbore. Casing removal requires that the casing string first be severed and the free end then pulled to the surface, to remove the severed portion.

Conventional apparatuses and techniques for extraction of well casing typically involve the use of multiple trips to move cutting and extracting equipment downhole. Thus, in removal operations a casing cutter is first lowered into the wellbore to cut the casing at a desired depth after which time the cutter is returned to the surface. A spear is then lowered inside the well and engaged to the free end of the casing. Once the free end of the casing is engaged, an attempt is then made to recover the casing by pulling, or, in the case jars are used, by a combination of pulling and jarring. If these attempts to remove the casing are unsuccessful, the spear assembly is removed from the wellbore and the cutter reattached to the workstring to sever the casing at a point above or below the original cut. The pulling/-jarring process is then repeated until the casing is recovered.

Such prior art apparatuses and techniques for retrieving well casing suffer from the disadvantage of the overall time and costs involved in completing a casing extraction. This time and expense is a result of the utilization of separate cutting and extraction tools which must be independently run downhole. Even when casing is retrieved without the need to complete a second cut of the casing, at least two trips are necessary for a complete cutting and retrieval operation. When a significant length of casing is extracted, considerable rig time must be used to move the tools downhole to the site of the cut. Time and expense are therefore increased when multiple cuts are necessary to retrieve the casing.

Additionally, systems for cutting and removing casing have been proposed wherein a grapple assembly or "spear" is adapted to be inserted in the top portion of the casing, with the degree of insertion of the spear into the casing limited by a stop ring. The spear in such systems is a mechanically actuated spear, which is actuated through use of interference. between the spear grapple and the casing, and through manipulation of the workstring. Such systems offer the disadvantages that there is a fixed distance between this stop and the cutting elements. Accordingly, when the grapple is placed inside the casing (and its depth is established by the placement of the stop), there is a fixed depth that which the cutter can be placed. Accordingly, if the first attempt to free the casing is not successful, this type of tool must be pulled out of the hole, and the distance between the grapple stop and cutting elements either lengthened or shortened to facilitate another cut of the casing at a different depth.

Accordingly, the present invention provides a new method and apparatus whereby casing may be cut and pulled with the string in tension, and whereby the grapples may be placed at virtually any desired location within the casing, allowing multiple attempts to cut and pull the casing on a single trip of the workstring into the wellbore.

SUMMARY OF THE INVENTION

Apparatus for cutting and retrieving a casing string in accordance with the present invention preferably include a grapple assembly which is adapted to be insertable into the casing, and which can be actuated to engage the casing at virtually any desired location. The grapple assembly will include a plurality of slips which are adapted to move between a first position wherein the slips do not substantially engage the casing (i.e., the grapple assembly may move longitudinally through the casing), and a second position in which the slips do substantially engage the casing (i.e., the grapple assembly will engage the casing with a minimum of either rotational or longitudinal movement).

The grapple assembly will preferably be rotatably mounted relative to a mandrel assembly which is adapted to be secured to the workstring. A cutting assembly will be operatively coupled to the lower end of the mandrel assembly such that the cutting assembly will be rotatable in response to rotation of the workstring.

In one particularly preferred embodiment, the grapple assembly will include a plurality of slips generally circumferentially arranged around the assembly, which slips will be moved between the engaged and unengaged positions in response to the application of fluid pressure within the workstring. In this one particularly preferred embodiment, the application of such fluid pressure will cause movement of the slips relative to a support member having a generally conical section, and such movement of the slips relative to such support member will cause the slips to engage or disengage the casing.

BRIEF DESCRIPTION OF THE DRAWINGS

FIG. 1 illustrates a side, external view of the apparatus of the present invention.

FIG. 2 illustrates a side, partial cutaway view of the cutting and retrieval apparatus illustrated in FIG. 1.

FIG. 3 illustrates a side, partial cutaway view of the upper assembly of the spear showing the relative position of the J-groove and the friction blocks.

FIG. 4 illustrates a side detail view of the grapple slips as mounted on the swivel cone.

FIG. 5 illustrates a side, detail view of the lower sub and wear collar.

FIG. 7 illustrates a side partial cutaway view of the tool as it would appear when lowered into the wellbore prior to cutting operation.

FIG. 8 illustrates a side view of the tool as it would appear during the cutting operation.

DETAILED DESCRIPTION OF PREFERRED EMBODIMENT

Figures 6A, 6B:
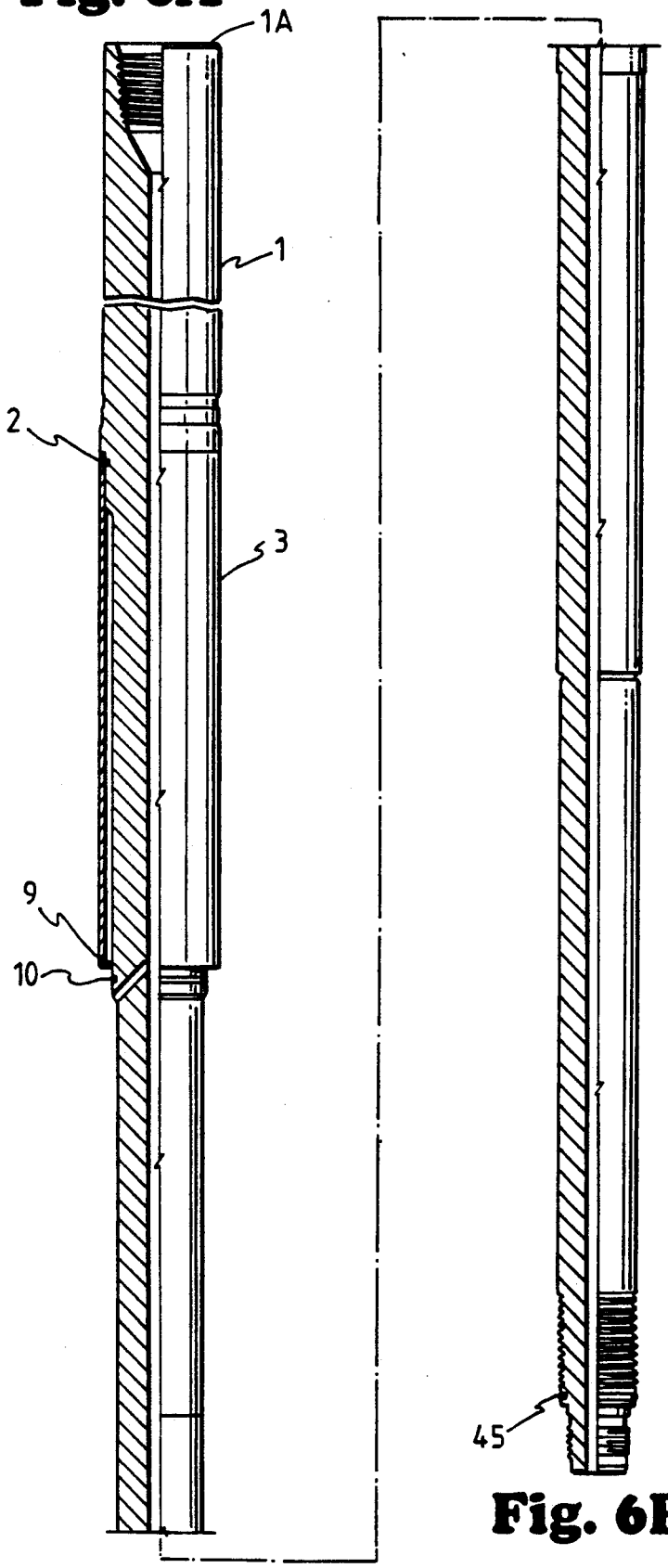
FIG. 6 illustrates a side view of the mandrel.

Referring now to FIG. 1 in more detail, therein is depicted an exemplary casing cutting and retrieving assembly 100 in accordance with the present invention. Casing cutting and receiving assembly 100 includes a body or mandrel 1 which includes an upper end attachment 1A for coupling to a workstring 105. An optional drilling jar 104 is depicted in one exemplary configuration between mandrel 1 and workstring 105. Drilling jar 104 may be one of any appropriate and conventional type as will be readily appreciated by those skilled in the art. As used herein, the term "workstring" includes any string, whether formed of drill pipe, work pipe, production tubing, etc., as may be utilized to perform well operations. Referring also to FIG. 7, therein is depicted casing cutting, and retrieving assembly 100 disposed within casing 101. Casing 101 is conventionally installed in a formation 102, and is secured in position by cement 103.

Referring again to FIG. 1, mandrel 1 of casing cutting and retrieving assembly 100 is threadedly coupled to a lower subassembly 49 which may in turn be connected to a cutting tool via box end 49A as will be further described herein. Mandrel 1 defines a bore 52 therethrough to accommodate the passage of well fluid as will be further described. The uppermost portion of the tool includes an outer shield or sleeve 3 which is threadedly disposed about the mandrel 1. Outer shield 3 serves to furnish physical protection of mandrel 1 and J-groove 51, the function of which will be further described herein. To prevent accidental unthreading, shield 3 is held in place by a fastener 2. (See FIG. 2). Shield 3 includes a pressure relief valve 4 which covers the access hole to a J-groove key 6.

A piston tube 8 is disposed about mandrel 1 immediately below shield 3. Piston tube 8 serves to house J-groove 51 and defines a hydraulic chamber 54, the integrity of said chamber being maintained by packing seals 10 and 11. (See FIG. 2). Contaminants are also prevented from entering J-groove slot 51 by the inclusion of a wiper seal 9. Piston tube 8 is biased in a closed or upper position by a compression spring 15.

A drive sleeve 14 is threadedly connected to piston tube 8 about mandrel 1 and secured by locking screw 13. Accidental unthreading of screw 13 is prevented by an internal retaining ring 12. Drive sleeve 14 serves to support friction blocks 19 and house compression spring 15. (See FIG. 2). Drive sleeve 14 also serves as a means to connect piston tube 8 and floating sleeve 24 as will be further described herein. An upper journal bearing 23, preferably a self-lubricating journal bearing, is disposed between sleeve 24 and sleeve 14 to permit axial and radial movement therebetween. A lower bearing 26, ideally an anti-friction bearing, is disposed below bearing 23 between sleeves 24 and 14. Bearing 26 serves to limit the travel of floating sleeve 24 and acts as a lower bearing for drive sleeve 14 and floating sleeve 24. Contamination of bearings 23 and 26 is inhibited by upper seal 22 and lower seal 28. Compression spring 15 is mounted on a ring 16 which constitutes a removable shoulder used to transmit the load of spring 15 to an external retaining ring 17. (See FIG. 2). Ring 16 also serves to facilitate the assembly of compression spring 15.

Figure 18:
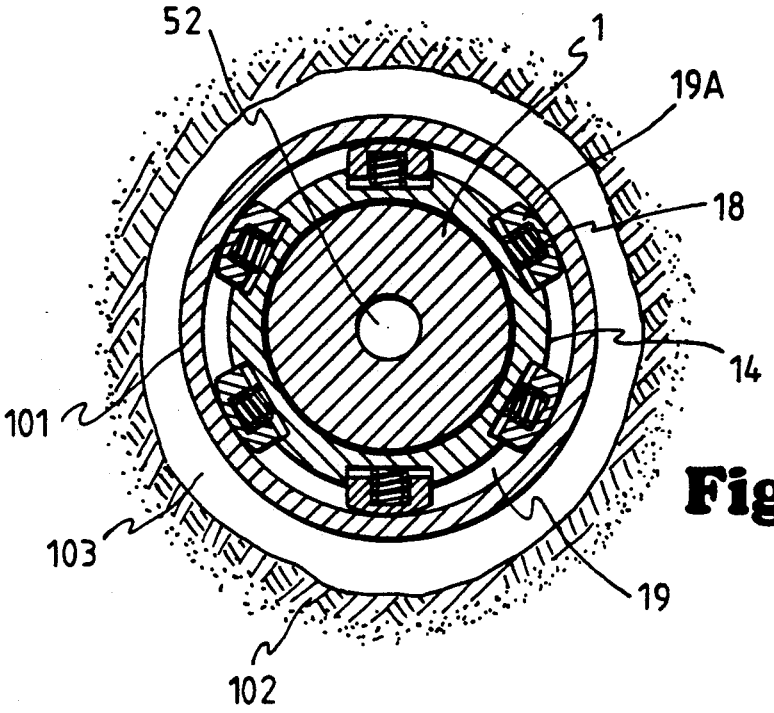
FIG. 18 is an end cross section of the friction blocks taken through lines 18—18' of FIG. 8.

A friction block assembly 19 is circumferentially disposed about drive sleeve 14 as illustrated in FIGS. 2 and 18. Friction blocks 19A are outwardly biased via a plurality of extrusion springs 18. In such a fashion, the outer contact surfaces of blocks 19A maintain continuous contact with the interior of the casing 101. As a result of such contact, friction block assembly 19 serves to provide resistance when mandrel 1 is rotated relative to tube 8. This rotational resistance is necessary to operate the J-groove 51 lock mechanism as will be further discussed herein. Friction blocks 19 are axially retained in place by a friction block retainer 20 which is circumferentially disposed about mandrel 1. Retainer 20 is held in place by an external retaining ring 21. Sleeve 24 is capable of axial movement about mandrel 1. When urged downward about the mandrel 1, sleeve 24 forces slips 32 into contact with the inner diameter of the casing 101. Floating sleeve 24 also allows drive sleeve 14 to rotate when grapple slips 32 are situated in engagement with the casing 100 as will be further described herein.

Figure 16:
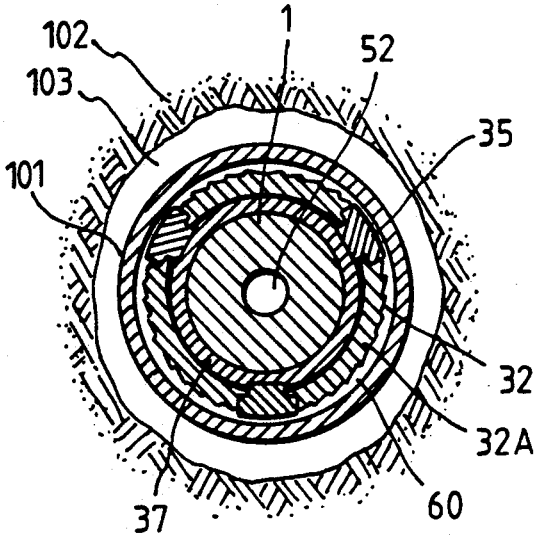
FIG. 16 is an end cross section of the grapple slips taken through lines 16—16' of FIG. 7.
Figure 17:
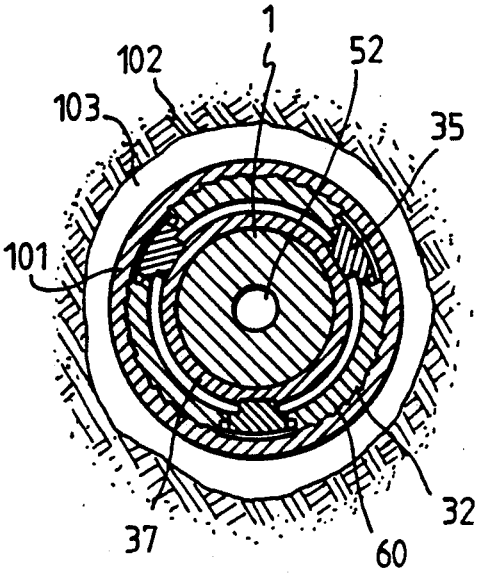
FIG. 17 is an end cross section of the grapple slips taken through lines 17—17' of FIG. 8.

Grapple slips 32 are disposed immediately below sleeve 24 as illustrated in FIG. 1. Slips 32 are comprised of a number of segments 32A which are held in place by slip guide rails 35. (See FIGS. 16–17). Sleeve 24 is also adapted to hold grapple slip segments 32A in suspension. Slip segments 32A preferably include a tongue or T-groove which fits in a complementary tongue or T-groove in floating sleeve 24, the overall structural makeup of slips 32 being generally conventional in fashion. Slip segments 32A preferably include tongues or grooves which fit into complementary tongues or grooves in rails 35. Rails 35 prevent rotational movement of segments 32A relative to swivel cone 37.

When actuated, grapple slips 32 serve to engage the inner bore of the well casing with a sufficient force to support the weight of the casing in addition to the overpull necessary to break the casing loose from the formation during retrieval. Slips 32 are physically moved into contacting engagement with the inner diameter of the casing by swivel cone 37 and floating sleeve 24. Structurally, swivel cone 37 is located immediately below grapple slips 32 and guide rails 35 as illustrated in FIG.

1. Slip guide rails 35 are retained in place by a fastener 34.

Figure 19:
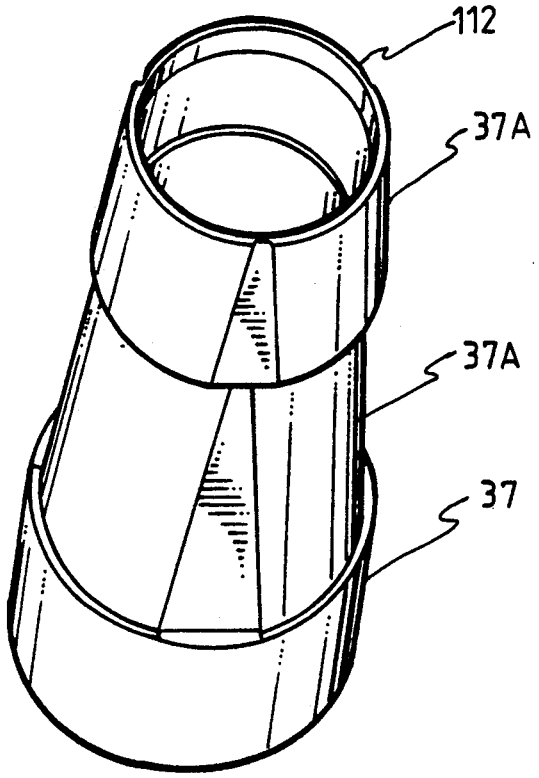
FIG. 19 is an oblique view of the swivel cone.

Swivel cone 37 comprises an upper cone shaped portion whose exterior slidably engages the interior of grapple segments 32A. (See FIGS. 4, 16 and 17). In such a fashion, when segments 32A are forced downward along rails 35 by the downward movement of sleeve 24, segments 32A are interiorly supported by the tapered wedge shaped surface provided by cone 37. In a preferred embodiment, cone 37 defines at least two tapered surfaces 37A which may be better seen by reference to FIG. 19. The upper conic portion of cone 37 is disposed proximate an upper journal bearing 33, and a lower journal bearing 38. Both bearings 33 and 38 are preferably self-lubricating. Bearings 33 and 38 permit rotation of cone 37 relative to mandrel 1. Bearings 33 and 38 are lubricated via a lubrication fitting 36 as shown in FIG. 2. Upper wiper seal 61 is retained by a cone bushing 30, which bushing also serves to protect the small end 112 of cone 37 and inhibit the introduction of contaminants therein. A lower wiper seal 39 serves to inhibit the introduction of contaminants into swivel cone 37.

Figure 14:
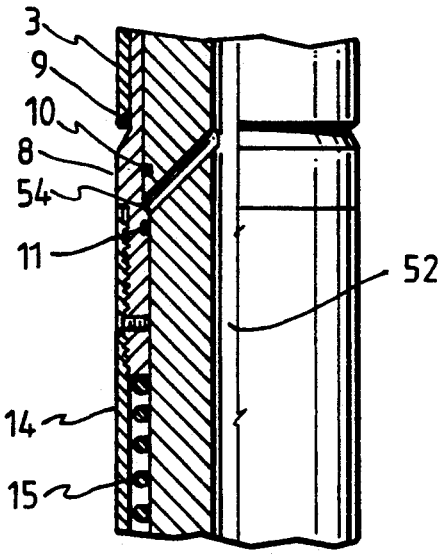
FIG. 14 is a side, detail cross section of the piston tube when positioned in a "closed" configuration.
Figure 15:
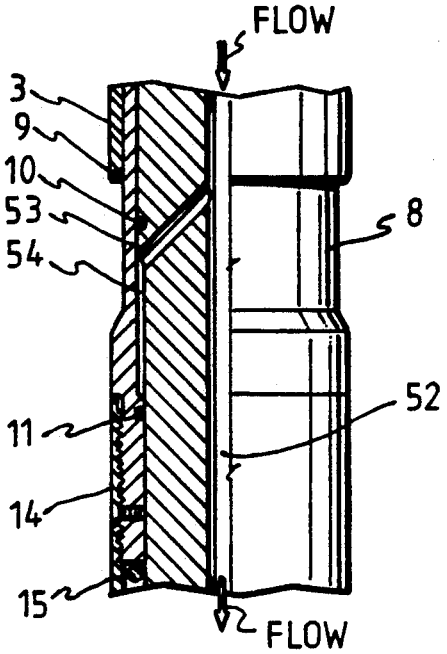
FIG. 15 is a side, detail cross section of the piston tube when in an "extended" position.

The engagement of slips 32 as referenced above is hydraulically actuated. When the tool is run in the hole and is situated at a desirable depth, mud or other fluid is pumped through mandrel bore 52. A majority of this fluid flow is utilized to operate the casing cutter tool 56 in a conventional fashion. However, backpressure in cutting tool 56 forces some fluid through actuation conduit 53 to hydraulic chamber 54. (See FIGS. 14 and 15). Fluid entering chamber 54 forces piston tube 8 and sleeve 24 downward. The downward movement of sleeve 24 forces grapple slips 32 downward over cone 37. This results in grapple segments 32A being moved outward in a radial direction by the wedge shaped profile of cone 37 as earlier described. In such a fashion, grapple slips 32 are forced downward until slip segments 32A contact and "bite" into the interior of casing 101.

In order to enhance the contacting relationship between slips 32 and casing 101, it is desirable to increase the axial length of slips 32 without unduly increasing the length of the entire tool. To accommodate these requirements, it has been found that cone 37 should be provided with multiple wedging surfaces so that swivel cone 37, when viewed in side cross section, describes two or more conic sections preferably defining a tapered angle in the range of 4°-30° with respect to the axis of the tool, and most preferably defining an angle within the range of approximately 4°-8°. This may be better seen by reference to FIG. 19 in which is illustrated a taper angle of 4°.

Figure 20:
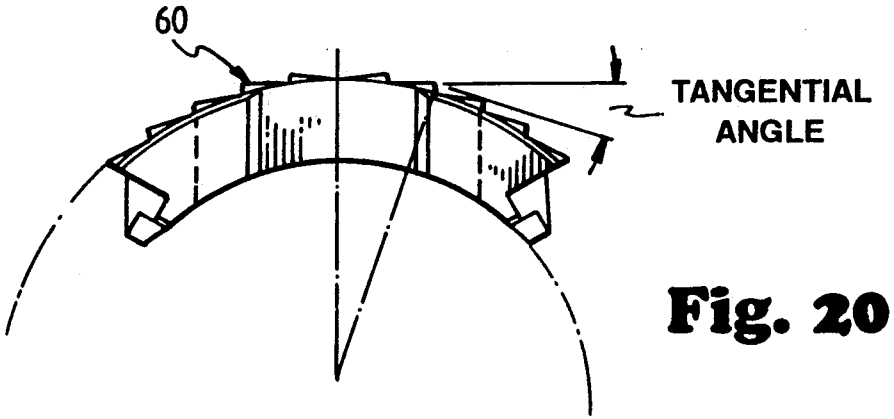
FIG. 20 is a side, detail view of the teeth formed along the contact surface of the slip segments illustrating the tangential angle of inclination of the teeth surface.
Figure 21:
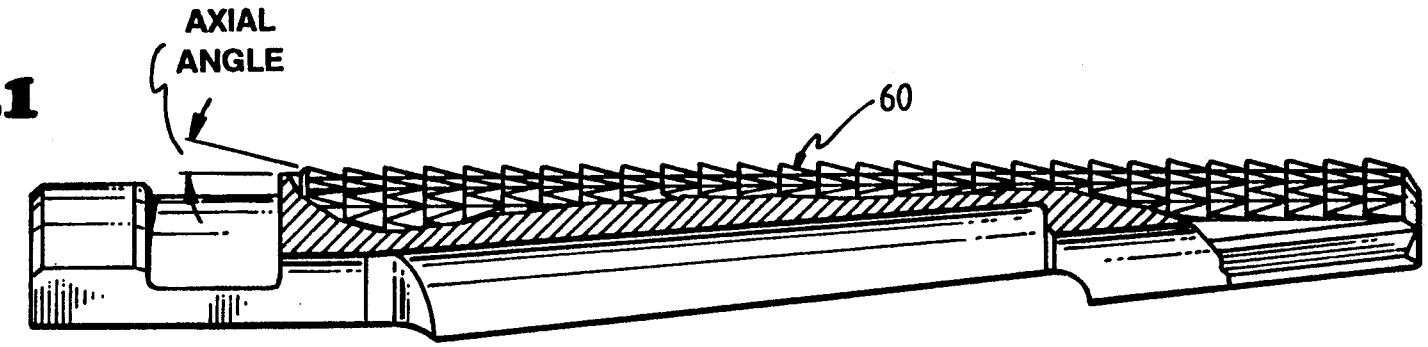
FIG. 21 is a side, detail view of the slip segments of FIG. 20 illustrating the axial angle of inclination of the teeth surface.

To additionally insure non-slipping engagement between slips 32 and casing 101, it is desirable to provide slips segments 32A with teeth 60 formed at an angle in the range of approximately 5°-60° in an axial direction and 0°-45° in a tangential direction. Preferably teeth 60 will be formed at an angle in the range of approximately 5°-30° in the axial direction and 5°-30° in the tangential direction. In one embodiment adapted for use in 9⅝ 47 pound casing, teeth formed at an angle of 12° in the axial direction and 8° in a tangential direction have been found to perform satisfactorily. See FIG. 20-21. In a preferred embodiment, teeth 60 are formed so as to offer nonslip capacity to both pulling tension and rotation in either a clockwise or counterclockwise direction. This nonslip capacity is achieved by the geometry of teeth 60 and their placement on slip segments 32A. Grapple segments 32A are preferably manufactured from hardened steel, e.g., induction hardened 4140 steel. The surface of teeth 60 may also include other elements to increase hardness.

Referring again to FIGS. 1 and 2, an upper thrust bearing 40 is situated immediately below swivel cone 37 so as to permit rotation between swivel cone 37 and lower sub 49. Bearing 40 rests on an upper bearing race 41 which achieves even load distribution between disc springs 42 and thrust bearing 40. In an embodiment designed to cut and retrieve 9⅝ casing, a conventional prestressed disc spring array incorporating 28 individual segments has been found to be desirable. Such disc springs will preferably be manufactured to D.I.N. spec. 2093.

Disc springs 42 serve to compensate for axial movement of the drilling string when the mandrel 1 is rotated under tension. As will be further described herein, it is desirable to rotate casing cutter 56 while a moderate to large tensional force is applied to the workstring. One reason for applying such tension to the workstring is to maintain constant pressure and rate of rotation of the cutting tool independent of deflections of the workstring caused by swells (in the case of a floating platform), and/or deflection caused by marine currents. Tension drawn on the workstring substantially reduces such deflection, thereby enhancing performance of the cutter tool 56 while reducing wear on the cutter and the drill string. Springs 42 behave as a solid member when subjected to a tensional force sufficient to place them in a fully collapsed position, e.g., >35,000 lbs., in the case of the embodiment described above utilizing a 28 disc spring array. Disc springs 42 are axially disposed above lower bearing race 43 on a lower thrust bearing 44. Bearing race 43 serves to establish an even load distribution between springs 42 and lower thrust bearing 44. Bearing 44 permits rotation of swivel cone 37 relative to lower sub 49.

Disposed immediately below lower thrust bearing 44 is a wear collar 46. Collar 46 defines the largest outside diameter of the tool and thus serves as a physical gauge which prevents the tool from entering an overly small diameter casing. Lower sub 49 is threadedly coupled to mandrel 1 below wear collar 46. Sub 49 forms an attachment means whereby a casing cutter or the like may be coupled to the mandrel. Sub locking nut 47 is secured to mandrel 1 with opposite hand threads to prevent lower sub 49 from accidentally uncoupling from said mandrel 1. Internal retaining ring 48 serves to prevent inadvertent unthreading of sublocking nut 47. Fluid leakage between bore 52 and the annulus of the casing is prevented by seal 45.

Figures 9A, 9B:
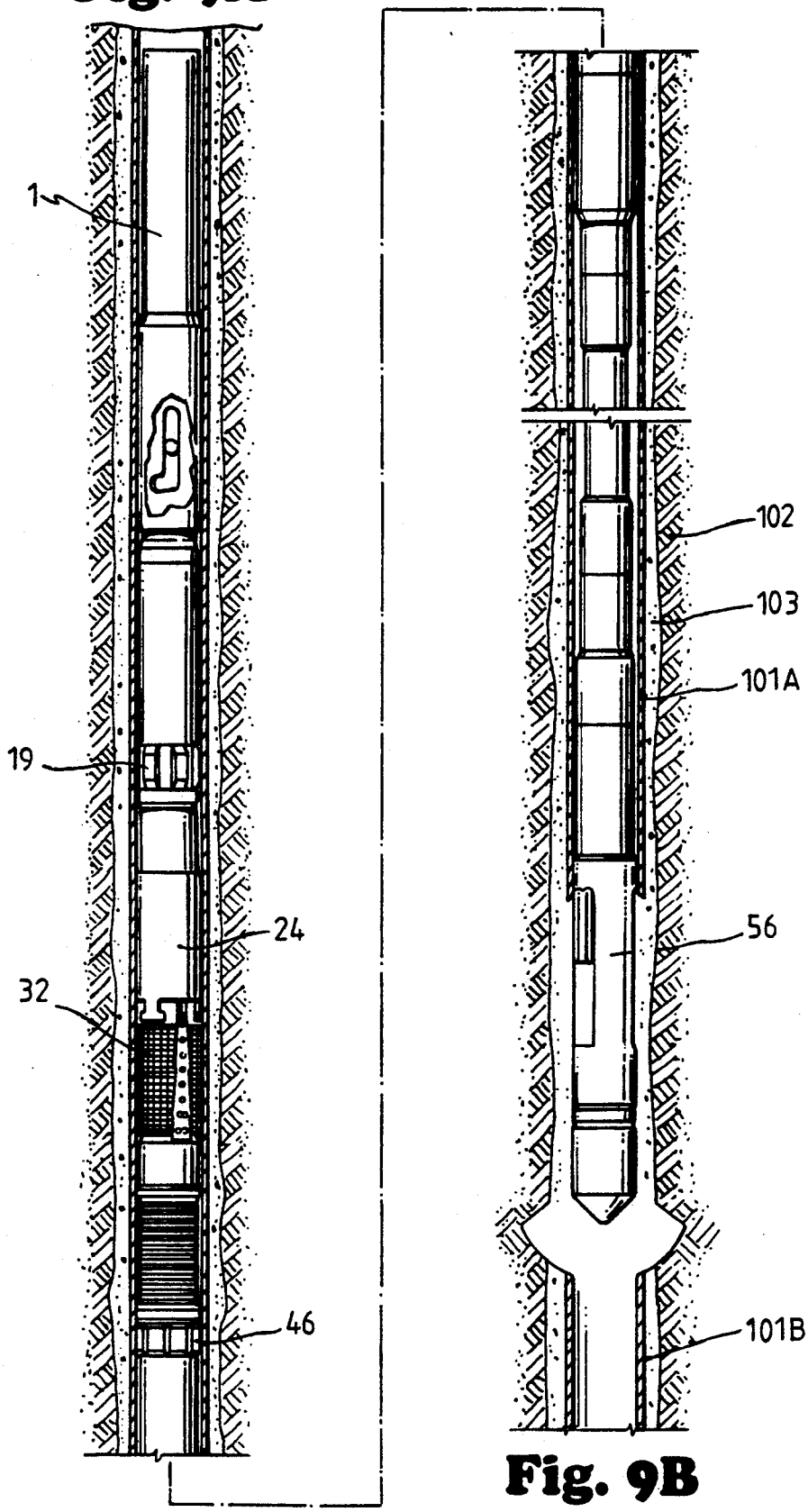
FIG. 9 illustrates a side view of the tool as it would appear during the extraction of the casing.
Figure 11:
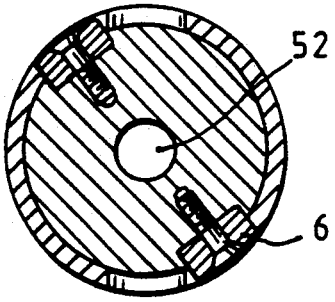
FIG. 11 illustrates a section view through lines 11—11' in FIG. 10.
Figure 13:
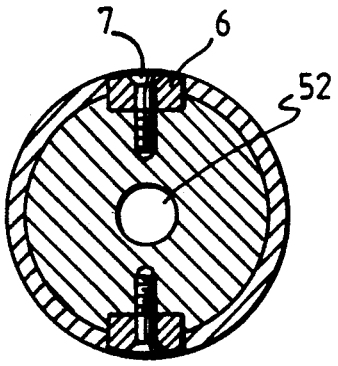
FIG. 13 is a section view through lines 13—13' in FIG. 12.
Figure 10:
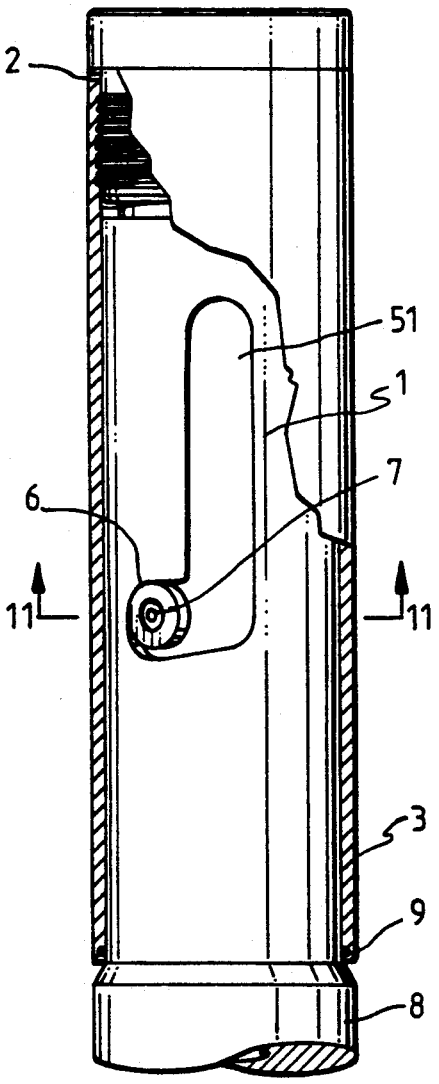
FIG. 10 illustrates a side, partial cutaway, detail view of the latching assembly of the mandrel sleeve when positioned in the "closed" position.
Figure 12:
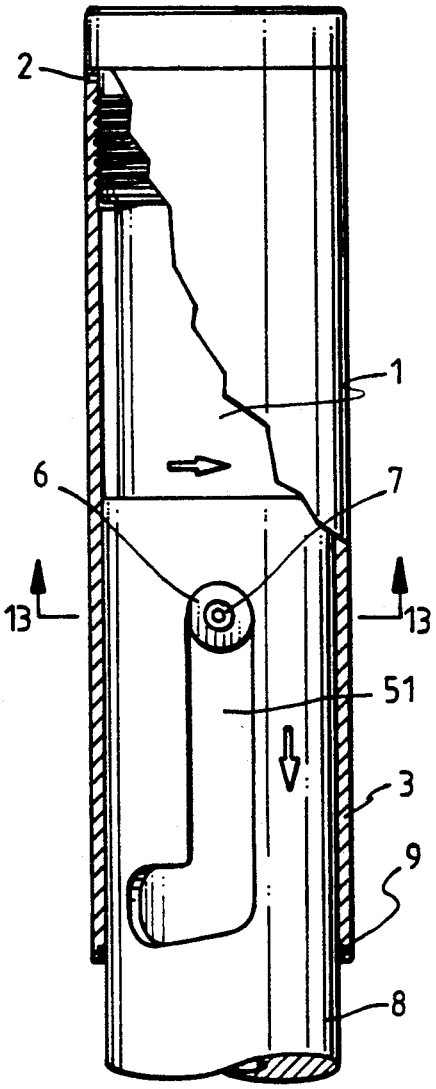
FIG. 12 illustrates a side, partial cutaway, detail view of the latching assembly of the mandrel when in the "engaged" position.

The operation of the present invention may be described as follows by reference to FIGS. 1-21 and especially by reference to FIGS. 7-9. The overall spear assembly is threadedly coupled to a standard workstring via female joint 1A or other attachment means conventional in the art. To aid in retrieval operations, one or more jars (not shown) may be coupled below the workstring and above the spear. A casing cutter 56, preferably an A-1 big inch cutter or marine cutter as described in U.S. Pat. No. 3,468,373, is then threadedly attached to sub assembly 49 via box end 49A. The cutting tool, retrieval tool, jars and workstring are then run in the hole to a desired and predetermined depth.

Referring to FIGS. 10-13, when the cutting/retrieval tool has been lowered to a desired location in the wellbore, the tool is rotated in left-hand rotation to disengage J-groove key 6 in J-groove 51. Relative rotation between key 6 and piston tube 8 is made possible by the resistance provided by friction blocks 19 which frictionally contact the interior of casing 101. Friction blocks 19 prevent the rotation of piston tube 8 relative to the rotation of the mandrel 1.

Disengaged, key 6 is now free to adopt axial movement along J-groove 51. Once key 6 has been released, mud pumps situated on the surface rig or platform are engaged, thereby creating fluid pressure through bore 52. A considerable amount of this fluid passes through bore 52 to cutting tool 56 so as to force cutting knives 57 into cutting engagement with the casing. Flow restrictions in cutting tool 56, however, create considerable backpressure so that some fluid is forced through activation conduit 53 to hydraulic chamber 54. This pressure overcomes the upward bias provided by compression spring 15 and forces piston tube 8 and floating sleeve 24 downward thereby forcing grapple slips 32 down along guide rail 35 and over swivel cone 37. This downward movement moves slips 32 into engagement with the interior wall of casing 101. The movement of the drive sleeve from a "nonengaged" to an "engaged" piston may be seen by reference to FIGS. 14 and 15.

Once slips 32 have engaged the casing, tension is applied to the workstring in an amount to moderately compress disc springs 42 and to straighten the workstring. This tension also serves to "set" the slips 32 in the casing. While the amount of such tension or overpull will vary on the depth of water in which the platform is situated, if any, and the nature of the platform (floating, stationary, etc.), it is desirable that an average overpull value of 10,000 lbs. be maintained on the workstring and the casing spear. The benefit of such overpull has been previously discussed in relation to the efficiency of the cutting tool and the reduction of wear on the workstring. Benefits of overpull also include the positive indication that such tension furnishes when the casing has been severed, thus reducing the chance that the cutting tool 56 will continue to be rotated in the hole after the casing has been cut.

Once a desired amount of overpull is achieved on the workstring and the slips are "set" in the wellbore, the cutting tool 56 is rotated below the spear in a conventional manner to effect a severance of the casing. Pump pressure is maintained during this operation to maintain cutting arms 57 in an extended position and to circulate cuttings out of the wellbore. Depending on the manner in which the casing has been severed in the wellbore, completion of the cutting operation (and thus severance of the casing) will ordinarily result in the free end 101A of the casing 101 being pulled or jerked a few feet up the wellbore due to the overpull maintained on the workstring. This will obviously result in a noticeable tension drop on the workstring. If a tension release in the workstring is not accomplished, completion of the cut will nevertheless result in a noticeable drop in fluid pressure. Both events evidence that the casing is severed and efforts may be undertaken for retrieval.

When it is established that the casing has been severed, pump pressure is discontinued and rotation of the cutter 56 is stopped. Reduction of pump pressure allows the cutter knives 57 to retract to a folded, relaxed position. Grapple slips 32 maintain their engaged position in the wellbore independent of pump pressure since they have been "set" by workstring tension. If the free end of the casing 101A underwent upward movement as a result of the overpull, this free end 101A may ordinarily be withdrawn from the wellbore by tension applied through the platform block. If the casing 101A does not initially respond to overpull, or subsequently becomes stuck, it may become necessary to jar the casing through use of a conventional drilling jar 104. This is accomplished in a conventional fashion by applying a tensional force in excess of the jar release setting tension. To enhance the performance of the jars, it is desirable that this release tension exceed the tension needed to compress disc springs 42 to a solid member.

If jarring the workstring is ineffective, the jars may be reset while the tool remains in the hole. This is accomplished by first lowering the workstring without rotation while maintaining pump pressure to hold grapple slips 32 in their engaged position. As this occurs, the cutter arms 57 of the casing cutter 56 unfold out into the area where the casing 101 has been severed until the cutter arms 57 come to rest upon the cut fixed end of the casing 101B. Arms 57 then serve to hold the workstring while the jars are reset after which time the jarring procedure is repeated as set forth above.

If the combination of jarring and pulling is ineffective, it may be necessary to withdraw the assembly up the bore and execute a second cut in the casing. To recut the casing 100, it is necessary to first release grapple slips 32 which involves reducing pump pressure and lowering the workstring (usually a few inches). This allows the upward bias in spring 15 to overcome the force in hydraulic chamber 54. The assembly is then rotated in right-hand rotation to reengage key 6 in J-groove 51. Casing cutter 56 is then adjusted to a different cutting level whereupon the aforedescribed cutting sequence is repeated.

What is claimed is:

1. An apparatus for cutting and retrieving a casing string, and adapted to be utilized on a workstring, comprising:

a hydraulically actuable grapple assembly adapted to be insertable into said casing, said grapple assembly including a plurality of slips adapted to move between a first position wherein said slips to not substantially engage said casing and a second position in which said slips substantially engage said casing, said slips moveable between said first and second positions at virtually any location within said casing, said slips movable from said first position to said second position in response to fluid pressure, said slips oriented to engage said casing and to place said casing in tension proximate the location at which said casing is to be cut;

a mandrel assembly extending through said grapple assembly, said mandrel assembly being mounted in rotatable relation relative to said grapple assembly; and a cutting assembly operatively coupled to said mandrel assembly.

2. The apparatus of claim 1, wherein said plurality of slips include a plurality of generally circumferentially arranged segments.

3. The apparatus of claim 1, wherein said cutting assembly includes a plurality of radially extendable cutting elements, said cutting elements extendable in response to hydraulic pressure.

4. The apparatus of claim 3, wherein said slips are moveable between said first and second positions in response to fluid pressure within said workstring.

5. The apparatus of claim 2, wherein said generally circumferentially disposed segments are supported about said periphery by a support, which support includes an upwardly tapering truncated cone generally coaxially arranged with said mandrel.

6. The apparatus of claim 5, wherein said truncated cone of said support defines at least one tapered angle in the range of approximately 4°-30°.

7. The apparatus of claim 2, wherein said generally circumferentially disposed segments include a plurality of teeth disposed about their outer contacting surfaces, said teeth having tangential cut angles when viewed in end cross section and axial cut angles when viewed in side cross section.

8. The apparatus of claim 1, further comprising a spring assembly operatively associated with said slips, said spring assembly operable to urge said slips from said second position toward said first position when said hydraulic pressure is reduced.

9. An apparatus adapted for use with a workstring to cut and remove casing from a well, said apparatus adapted to allow multiple cuts of said casing on a single trip of the workstring into said well, comprising:

a spear assembly having a connector to facilitate coupling of said assembly to said workstring, said spear assembly comprising, a mandrel, a housing assembly rotatably mounted around said mandrel, and a plurality of grapple slips generally circumferentially arranged around said body assembly, said slips moveable between a first position and a second position, wherein in said second position said slips will engage said casing and allow tension to be applied to said casing through said workstring, and wherein in said first position said slips will substantially be disengaged from said casing and allow movement of said spear assembly upwardly and downwardly through said casing said slips from said first position to said second position in response to fluid pressure; and a cutting assembly coupled to said mandrel and adapted to selectively cut said casing.

10. The apparatus of claim 9, wherein said plurality of grapple slips are moveable between said first and second positions in response to fluid pressure within said workstring.

11. The apparatus of claim 9, wherein said body assembly includes a grapple support member having at least one generally conical support section operatively engaging generally inner surfaces of said grapple slips, wherein movement of said grapple slips relative to said conical support section causes movement of said grapple slips between said first and second positions.

12. The apparatus of claim 9, wherein said plurality of grapple slips include teeth which are adapted to grip the inner diameter of said casing when said slips are in said second position and to minimize both axial and rotational movement between said body assembly and said casing.

13. The apparatus of claim 9, further comprising a spring operatively associated with said slips, wherein said slips are moveable from said second position to said first position at least partially in response to a force applied by said spring.

14. A method for cutting and removing casing from a wellbore on a single trip of a workstring into said wellbore, comprising the steps of:

securing a cutting assembly and a grapple assembly to said workstring, said cutting assembly being selectively actuable at least partially in response to hydraulic pressure and said grapple assembly being actuable at least partially in response to hydraulic pressure;

lowering said cutting assembly and said grapple assembly into said wellbore until said cutting assembly is at a depth where it is desired to cut said casing;

applying hydraulic pressure in said workstring to actuate said grapple to cause said grapple to engage said casing;

applying tension to said workstring to place said casing in tension through said grapple assembly;

rotating said workstring to rotate said cutting assembly, which has been extended in response to hydraulic pressure, so as to cut said casing; and after said casing has been cut, applying pull on said workstring to remove said casing from said wellbore.

15. The method of claim 14, further comprising the steps of:

releasing said hydraulic pressure to release said grapple assembly from engagement with said casing;

moving said workstring to place said grapple assembly at a different desired placement within said cut casing section; and applying hydraulic pressure to cause said grapple assembly to engage said casing at said different desired location in said casing.

16. The method of claim 14, further comprising the steps of:

attaching a drilling jar to the workstring; and after cutting said casing, actuating said drilling jar to impart an impact force on said casing.

* * * * *